United States Patent [19]

Mueller

[11] Patent Number: 5,046,381

[45] Date of Patent: Sep. 10, 1991

[54] GRIP SYSTEM FOR HAND TOOLS AND INSTRUMENTS

[75] Inventor: Lawrence P. Mueller, 3700 Ithaca, Merced, Calif. 95348

[73] Assignee: Lawrence P. Mueller, Merced, Calif.

[21] Appl. No.: 367,234

[22] Filed: Jun. 16, 1989

[51] Int. Cl.[5] ..... G05G 1/04; B26B 13/00; B26B 27/00

[52] U.S. Cl. ..... 74/558; 74/558.5; 74/557; 30/232; 30/298

[58] Field of Search ..... 74/551.8, 551.5, 563, 74/558, 557, 558.5; 30/232, 298, 340, 341; 81/177.3; 606/174; 16/110 R

[56] References Cited

U.S. PATENT DOCUMENTS

| | | | |
|---|---|---|---|
| D. 157,104 | 1/1950 | Tuttle et al. | D28/55 |
| 158,526 | 1/1875 | Riedling | 30/232 |
| D. 188,788 | 9/1960 | Lamb | D22/3 |
| D. 233,864 | 12/1974 | McClure | D86/10 B |
| D. 248,534 | 7/1978 | Bäckström | D8/57 |
| D. 249,117 | 8/1978 | Bäckström | D8/57 |
| D. 250,389 | 11/1978 | Vitetta | D8/57 |
| D. 251,701 | 5/1979 | Hayashi | D8/57 |
| 258,089 | 5/1882 | Mann | 30/232 |
| D. 278,117 | 3/1985 | Smith | D8/57 |
| 354,363 | 12/1886 | Titus | 30/232 |
| 435,240 | 8/1890 | McMullen | 30/232 |
| 519,999 | 5/1894 | Godbey | 30/232 |
| 779,957 | 1/1905 | Minter | 30/232 |
| 792,089 | 6/1905 | Towers | 30/232 |
| 896,338 | 8/1908 | Tolman | D28/55 X |
| 1,174,887 | 3/1916 | Meriwhether | 30/298 |
| 1,339,282 | 5/1920 | Pelnar | 30/232 |
| 1,386,470 | 8/1921 | Gower | 30/232 |
| 1,559,839 | 11/1925 | Asher | 30/298 |
| 1,775,562 | 9/1930 | Kerns | 30/232 |
| 2,184,909 | 12/1939 | Crompton | 30/256 |
| 2,470,905 | 5/1949 | Springer et al. | 30/298 |
| 2,669,993 | 2/1954 | Curutchet | 128/321 |
| 2,788,573 | 4/1957 | Schanno | 30/232 |
| 2,819,521 | 1/1958 | Parker | 30/298 X |
| 2,863,459 | 12/1958 | Casper | 128/321 |
| 3,015,160 | 1/1962 | Fogle | 30/232 |
| 3,295,203 | 1/1967 | Thompson | 30/232 |
| 3,407,816 | 10/1968 | Curutchet | 128/318 |
| 3,888,006 | 6/1975 | Roberts | 30/298 |
| 4,140,124 | 2/1979 | Curutchet | 30/232 |
| 4,189,831 | 2/1980 | Sonntag | 30/232 |
| 4,726,371 | 2/1988 | Gibbens | 128/305 |
| 4,742,617 | 5/1988 | Gauvry | 30/232 |
| 4,744,147 | 5/1988 | Modin | 30/254 |

FOREIGN PATENT DOCUMENTS

| | | | |
|---|---|---|---|
| 1105210 | 11/1955 | France | 30/232 |
| 1227928 | 8/1960 | France | 30/232 |

*Primary Examiner*—Vinh T. Luong
*Attorney, Agent, or Firm*—Fitch, Even, Tabin & Flannery

[57] ABSTRACT

A grip system for tools, instruments and other objects held or operated by hand includes a plurality of finger pieces, each having a concave surface to accommodate the convexity of finger palmar surfaces of the holding hand. Each of the finger pieces is connected to the outer wall of a discrete finger piece mount having ends suitable for interdigitation with the adjacent end of another such mount. Each finger piece has a cavity for housing a receiving stem. The receiving stem extends from the working portion of the hand tool or instrument and is telescopically received within the cavities of the discrete finger piece mount. Alternative mounting mechanisms are also described.

20 Claims, 6 Drawing Sheets

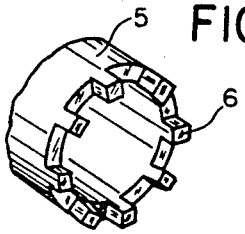
FIG. 5A
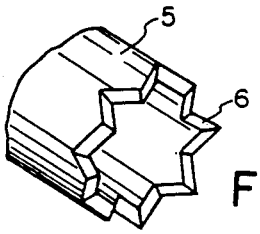
FIG. 5B
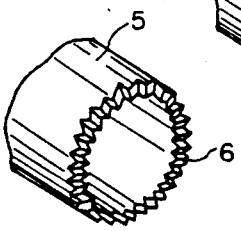
FIG. 5C
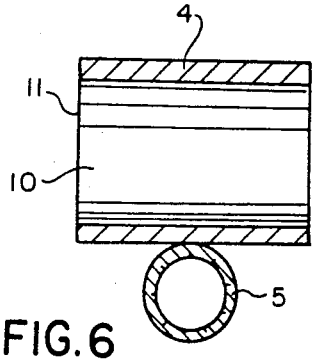
FIG. 6
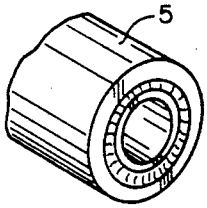
FIG. 5D
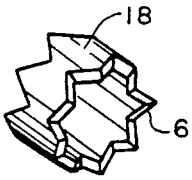
FIG. 7A
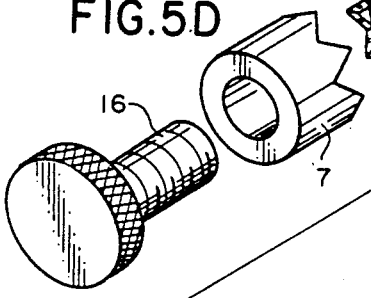
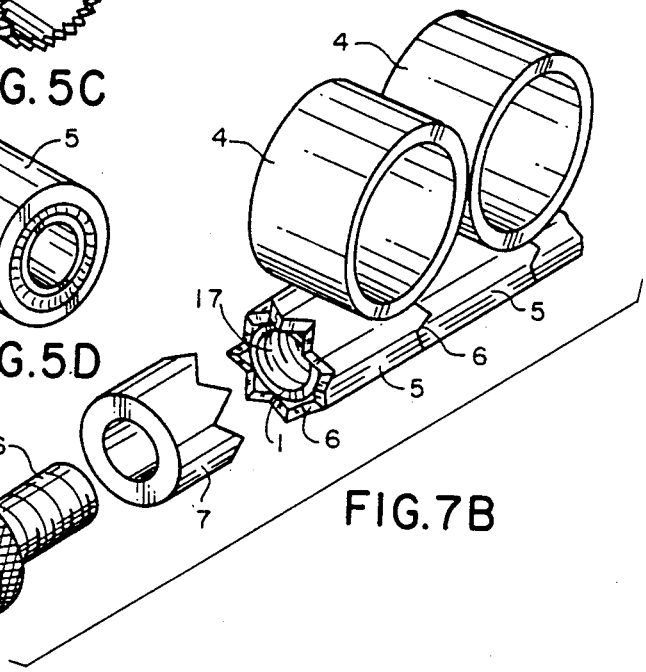
FIG. 7B
FIG. 8A
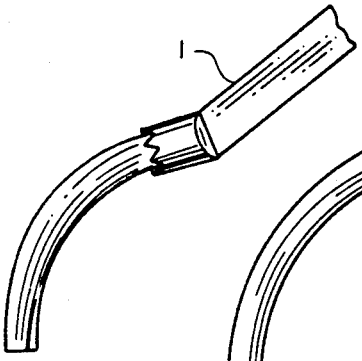
FIG. 8B
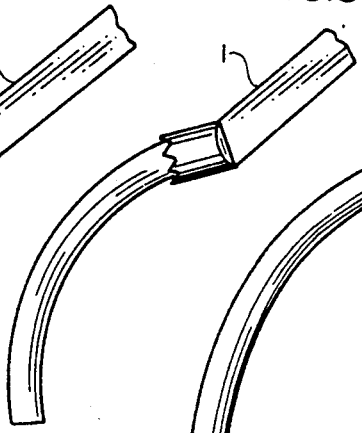
FIG. 8C
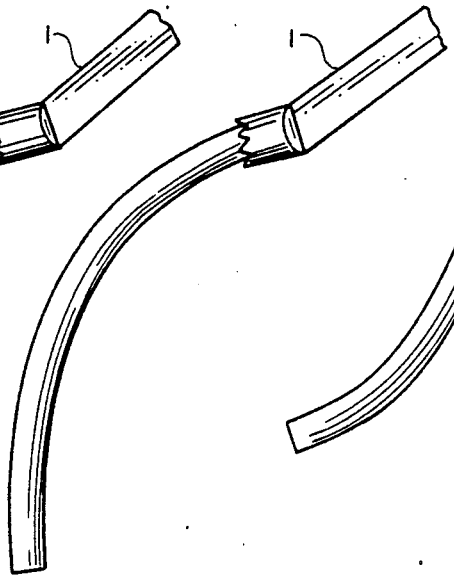
FIG. 8D
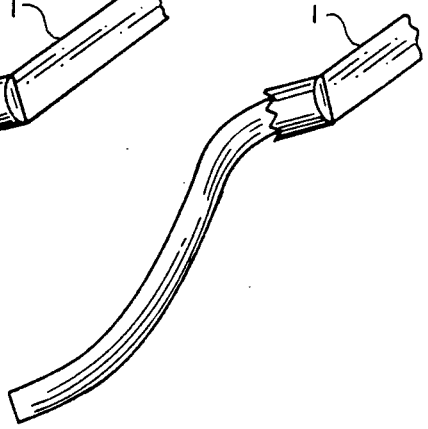

GRIP SYSTEM FOR HAND TOOLS AND INSTRUMENTS

FIELD OF THE INVENTION

The present invention relates to a grip system for hand tools and instruments. More particularly, this invention concerns an improved, customized grip system which is applicable to hand tools of different designs, including pivoted hand tools, such as scissors, pincers, pliers, surgical needle holders; single grip hand tools, such as a hammer, hatchet, screwdriver, knife; other hand and power shop or garden tools; small hand-held appliances, such as a hair dryer and curler, and brushes; single grip sporting goods, such as a racquet or paddle, fishing pole, pistol grip, and archery equipment; and levers with an end hinge point, such as forceps. The grip system can be applied to most any object grasped with one or both hands in the same place by the same person, such as musical instruments.

In the traditional type of hand tools no special attention is paid to the way the user holds the tools in the hand. Either no means are provided to keep the thumb and fingers in defined positions (e.g. conventional hammers, knives, garden tools) or the thumb and one or more fingers are forced into uncomfortable positions, with no or little attention to the anatomy of the individual user's hand (e.g. scissors, surgical needle holders). This is particularly unsatisfactory in the case of surgical instruments, during the use of which the doctor's hand must perform a variety of types of movements with high precision; or in single grip cutting instruments, such as a knife, where slippage of the grip could result in injury to the user. The design of the handle or grip of conventional tools, due to their being usable by a great variety of hand anatomies, may result in the instrument slipping in the hand during use or lessening the force that can be exerted. Furthermore, the use of an instrument which is uncomfortable to hold for tedious work may tend to increase the chance of an error or early fatigue.

2. Description of the Prior Art

There are numerous attempts known in the art for designing various grips for hand tools, especially surgical instruments that improve the performance of these articles during operation.

U.S. Pat. No. 2,669,993 shows a bicapsular grip for pivoted surgical instruments. The instruments are equipped with two capsular members, one for housing the thumb's ball and the other one the index finger's ball. The capsular member housing the thumb's ball is integral with a ring like member similar to the ring occupied by the thumb in ordinary pivoted instruments, such as scissors. The inner surface of this ring like member is bevelled such that throughout its entire length, it will contact the surface of the thumb without exerting pressure. The middle finger is accommodated in a half-ring. The disclosed instruments are cross-manual, i.e. are designed to be held across the hand, the thumb pointing outward relative to the lever to which the capsular member housing the thumb is attached. One object of the invention disclosed in this publication is to increase considerably the tactile sensitivity and "conductibility" of the instrument.

U.S. Pat. No. 3,407,816 discloses pivoted surgical instruments with handles, one fitting in the user's hand and the other being actuated by the user's thumb. The described handles are "aximanual", i.e. are designed to be held in the direction of the axis of the hand. Unlike conventional scissors, only the handle engaging a "capsule" or thumb piece is moved during operation. The design contains capsules intended to be engaged by the index finger and the middle finger, respectively. The aximanual handling of the instruments brings about a more efficient way of performing operations.

U.S. Pat. No. 4,140,124 is directed to pivoted surgical instruments with a generally triangular first handle for fitting into the palm, and a second handle for receiving the thumb. The instrument extends along the axis of the user's hands and may therefore be termed as an aximanual instrument. The palm of the hand supports the instruments and holds stationary the lower branch so that the upper blade can be aimed without oscillation and accomplish its objective with great precision.

A surgical cutting instrument is disclosed in U.S. Pat. No. 4,726,371. The instrument is carried on the small finger of a surgeon's hand to enable to make cuts while the surgeon holds another instrument in the same hand. The cutting instrument comprises a sleeve mounted on the surgeon's small finger, and a scissor mounted on the sleeve.

None of these publications addresses the problem of accommodating hands of various sizes and shapes in rest position, known as "the position of function" in the medical literature, around a variety of hand tools and instruments, in order to maximize power and perception of the object to be manipulated during use of the instrument.

SUMMARY OF THE INVENTION

The present invention provides a grip system, in which the contact surfaces between the finger pads and, if desired, thumb of the holding hand and the instrument are increased and thereby the power and perception of the object to be manipulated are maximized and the risk of slippage eliminated. This is especially advantageous in the case of pivoted instruments and levers, particularly pivoted surgical instruments, for example scissors.

The finger pieces and the thumb piece, if present, can be manufactured in a large variety of sizes and shapes in conformance with the anatomy of the user's hand and the intended use. Accordingly, the invention provides for a flexible, customized grip system, that can accommodate hands of various sizes.

In another aspect, the new grip system of the present invention allows for an easy adjustment of the finger (and thumb) grips relative to the stem(s) of the instrument, consistent with the anatomy of the user's hand, in the most comfortable and efficient position.

The invention finds particular utility in conjunction with surgical instruments, where firm holding and easy and precise manipulation are particularly important.

More particularly, the present invention relates to a grip system for tools, instruments and other objects held and operated by hand. The grip system comprises a plurality of finger pieces, each having a concave surface, cylinder, ring, or other form fitting surface to accommodate the fingers of the holding hand. Each of the finger pieces is connected to the outer wall of a discrete finger piece mounting means having ends smooth or suitable for interdigitation with the adjacent end of another such mounting means and a cavity for housing a receiving stem. The receiving stem that extends from the working portion of the hand tool or instrument is telescopically received within the cavities of the discrete finger piece mounting means. Alternative mounting means are also described below, for example, the cylinders, rings, or capsule may also be mounted directly onto the receiving stem or handle through a peg-in-hole system.

In a particular embodiment, the grip system according to the present invention also comprises a thumb piece having a concave surface to accommodate the convexity of the ball of thumb of the holding hand. In the case of single grip hand tools, the finger pieces and the thumb piece may be connected to the same receiving stem or through two separate stems, both connected to an oval or tubular palm grip. If the hand tool or instrument has two nonfused stems, such as scissors, forceps or other pivoted instruments, the finger pieces and the thumb piece are connected to two different receiving stems.

By appropriate selection of the size and shape of the thumb and finger pieces, and by securing the finger pieces on a receiving stem in a configuration consistent with the user's hand anatomy, the configuration of the instrument can be customized for a particular user. Furthermore, by virtue of the interfitting end portions of the finger piece mounting means, or simply by pressure created by a threaded knob or set screw in the stem end, a preferred orientation can be established and maintained when the thumb and finger pieces are mounted on the receiving stem. The customized orientation of the finger pieces could also be defined and maintained by other means of fixation to the stem or handle, such as a peg in hole technique, glue or other attaching mechanism.

The grip system according to the invention may further comprise spacers between the discrete finger piece mounting means, and end members for securing the finger pieces and, if desired, the thumb piece can be secured on the respective receiving stems at a desired angle.

The finger pieces may be secured to their respective mounting means with their axes angled relative to the axis of the finger piece mounting means.

Alternatively, the finger pieces can be attached to the outer walls of their respective mounting means pivotally, so that they can pivot about their points of attachment to the surface of the finger piece mounting means.

The thumb piece is preferably secured to the receiving stem so that its longitudinal axis is substantially parallel with the longitudinal axis of the receiving stem, to which it is attached, but variations can be introduced to suit the user's preference. For crossed levers, requiring a stronger grip, such as pliers and pruning shears, the thumb stem can be lengthened to incorporate the base of the thumb and part of the palm into the gripping action.

All systems described can be adapted for right and left hand use, or both hands if needed on one or two separate levers or handles.

BRIEF DESCRIPTION OF THE DRAWINGS

FIGS. 5A–5D are enlarged perspective views of alternative embodiments of intermeshing ends of the cylindrical mounting means with FIG. 5A depicting rectangular teeth, FIG. 5B showing saw teeth, FIG. 5C demonstrating fine teeth, and FIG. 5D demonstrating non-slip washers attached to the mounting cylinders;

FIG. 6 is a sectional view along line 6—6 of FIG. 4A;

FIG. 7A is a perspective view of a spacer;

FIG. 7B is a perspective view of an end cap for securing a series of finger pieces telescopically mounted on the receiving stem in a desired position;

FIGS. 8A–AD illustrate various stem configurations for various hand anatomies;

DETAILED DESCRIPTION OF THE PREFERRED EMBODIMENTS

Figure 1:
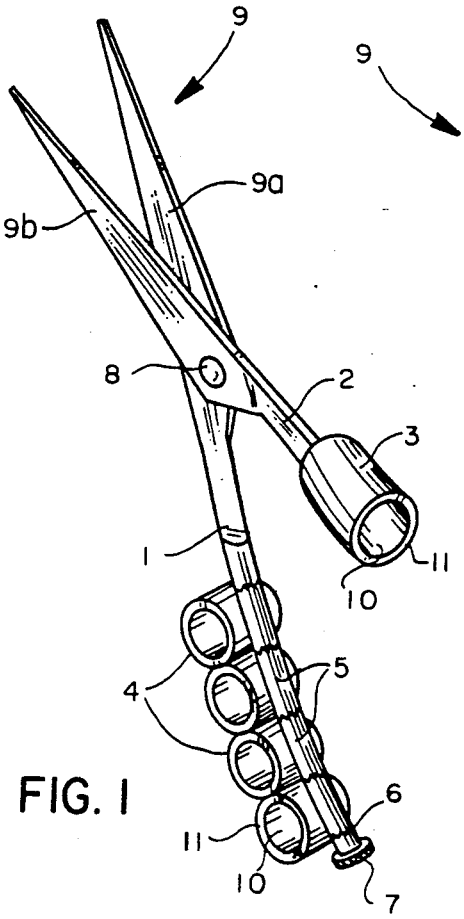
FIG. 1 is the perspective view of a grip system embodying various aspects of the invention applied to scissors.
Figure 2:
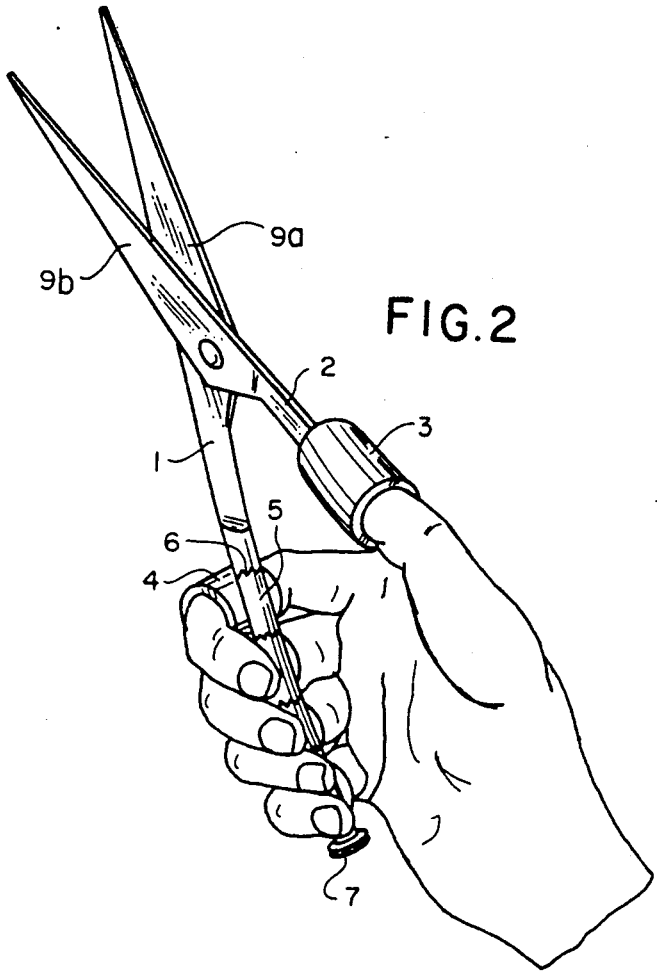
FIG. 2 illustrates the scissors of FIG. 1 being held.
Figure 3A:
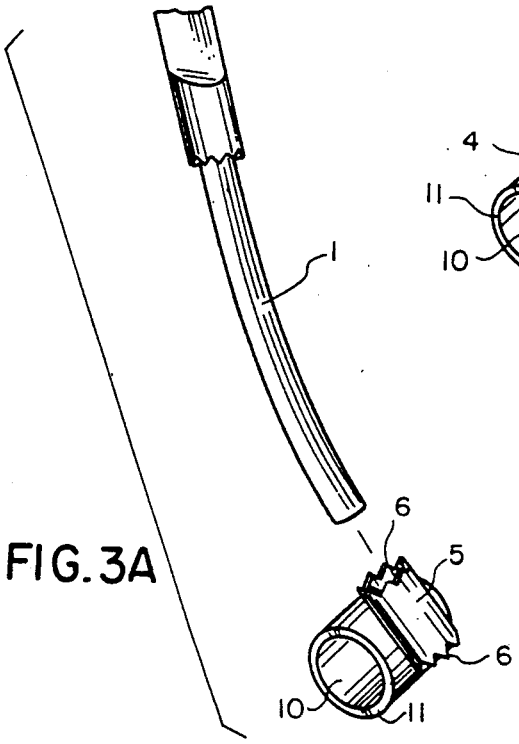
FIGS. 3A, 3B and 3C demonstrate the mounting of a finger piece on a receiving stem.
Figure 3B:
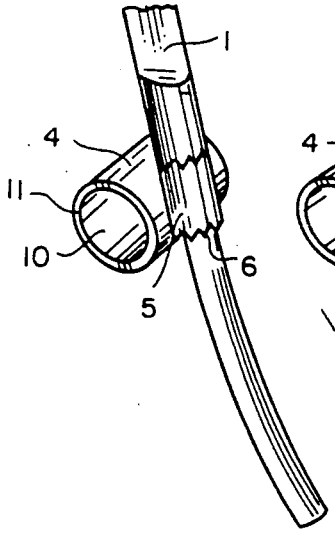
Figure 9A:
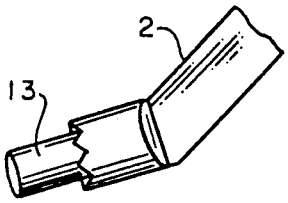
FIGS. 9A–9D illustrate different stem configurations for receiving the thumb piece mounting means.
Figure 9B:
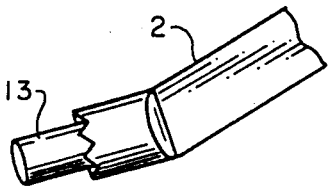
Figure 9C:
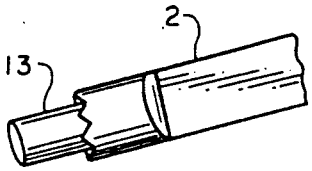
Figure 9D:
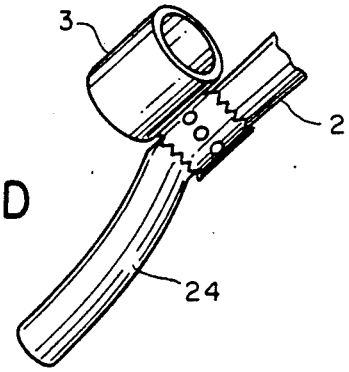

A pair of preferred scissors are illustrated in FIGS. 1 and 2. The illustrated surgical scissors comprise a first receiving stem 1 and a second receiving stem 2 pivotally connected in a conventional manner by pivot 8. At one side of the pivot the receiving stems are connected to cutting blades 9, the blades being termed first and second working portions (9*a*) and (9*b*) respectively, which are connected to respective first and second receiving stems. On the first receiving stem 1 finger pieces 4 are mounted by finger piece mounting means 5. Said finger pieces 4 are cylinders, each having a cavity 10 for accommodating the user's fingers, and an outside wall 11. In this preferred embodiment, the finger piece mounting means 5 are also cylindrical and are shifted on the first receiving stem 1 so that their respective ends 6 are interdigitated. This is shown in FIGS. 3A and 3B. By proper orientation of the finger piece mounting means 5 the finger pieces 4 are mounted on the first receiving stem 1 in such an angle that best fits the anatomy of the user's hand. The desired configuration is fixed by first end member7. The second receiving stem 2 is provided at its rear end with a thumb piece 3 for housing the thumb's ball. In this special case said thumb piece 3 is a capsular body having a cavity 10 and an outer wall 11. The axis of the capsular thumb piece 3 is essentially parallel with the axis of the second receiving stem 2 and its end is open to receive the user's thumb. FIG. 1 shows the thumb piece 3 extending only adjacent the upper thumb joint. It will be appreciated that the thumb piece or stem could extend adjacent to the base of the thumb and also include a portion of the palm (FIG. 9D).

As clearly shown in FIG. 2, the position of the thumb piece 3 orients the user's thumb in the direction of the second receiving stem 2 so that the thumb is in the extension of said second receiving stem 2. By housing the ball of thumb inside of the capsular thumb piece 3, resting on its concave inner surface, the contact surface between the thumb and the instrument is maximized. FIG. 2 also shows that in this embodiment the other digits of the user's hand are housed within their respective finger pieces 4.

The scissors illustrated in FIGS. 1 and 2 are operated in a conventional way.

Although these and other Figures illustrate configurations with four finger pieces and one thumb piece, other arrangements with only two or three finger pieces are equally possible, and the cosmetic appearance of the finger pieces can also be varied.

Figure 3C:
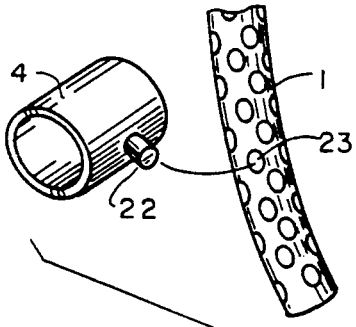

FIGS. 3A and 3B demonstrated one means of attaching the finger pieces to the receiving stem, employing cylinders slid onto the stem. FIG. 3C shows an alternative mounting means wherein pegs 22 attached to the finger pieces slide in an interference fit into holes 23 on the receiving stem, with their preferred orientation being maintained by either friction alone or glue.

FIGS. 4A–4I illustrate some of the numerous variations available in the construction of finger and thumb pieces and their mounting means.

Figure 4A:
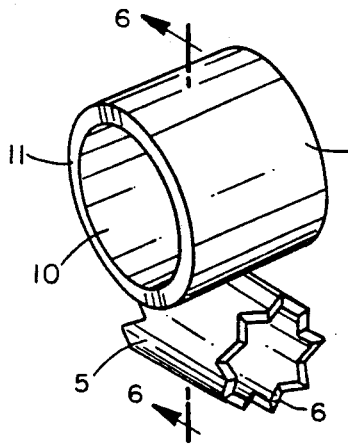
FIGS. 4A–4I are perspective views of alternative embodiments of finger and thumb receiving pieces attached to their respective mounting means, which preferably is in the form of a cylinder.

In FIG. 4A a cylindrical finger piece 4 is fused at an approximately 90 degree angle to a cylindrical finger piece mounting means 5.

Figure 4B:
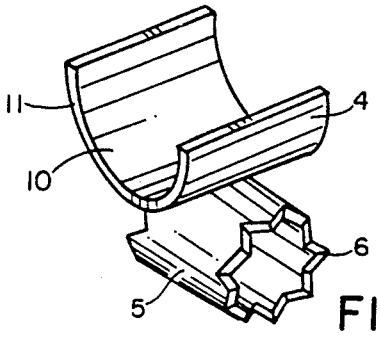

In the embodiment shown in FIG. 4B the finger piece 4 is a half cylinder and is positioned at a 90 degree angle relative to the axis of the finger piece mounting means 5.

Figure 4C:
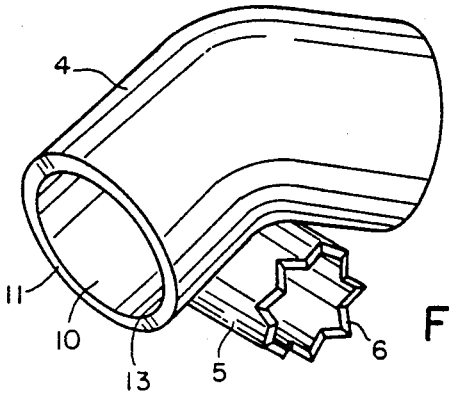

FIG. 4C illustrates a "double cylinder" shaped finger or thumb piece 4, where the two cylindrical portions are attached to each other with an approximately 30 degree angle, to accommodate a finger or thumb joint. In this embodiment, the finger is housed in the cavity 10 of the cylindrical finger piece 4 essentially in its full length, the palmar surface of the digits resting on the concave inner surface of the bottom part 13 of the cylinders. The angle connecting the two cylinders housing the finger may be variable.

Figure 4D:
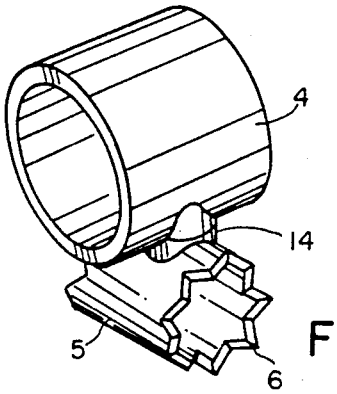

In the embodiment shown in FIG. 4D, a cylindrical finger piece 4 is fixed to a cylindrical finger piece mounting means 5 by means of a swivel 14, so that finger piece 4 can freely pivot about swivel 14 in any direction. The finger cylinder could then be fixed in that preferred position or remain mobile.

Figure 4E:
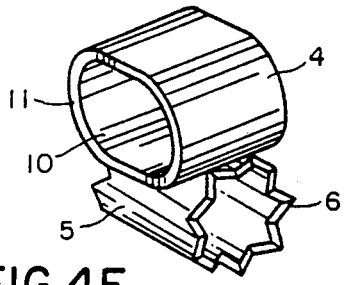

FIG. 4E illustrates an irregular cylinder having flattened or oval sides as a finger or thumb piece 4.

Figure 4I:
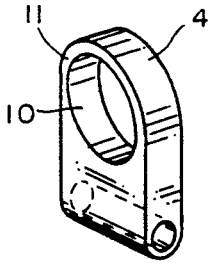
Figure 4F:
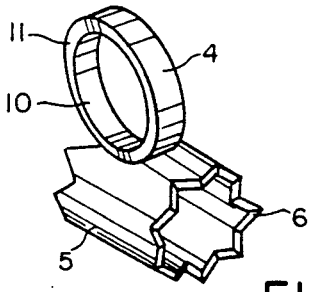

FIG. 4F illustrates a narrow cylinder or ring as a finger piece 4 secured on a cylindrical mounting means 5.

Figure 4G:
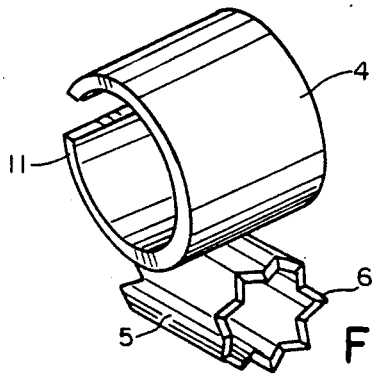

The finger piece 4 shown in FIG. 4G is adjustable and is, therefore, suitable for accommodating fingers of different sizes.

Figure 4H:
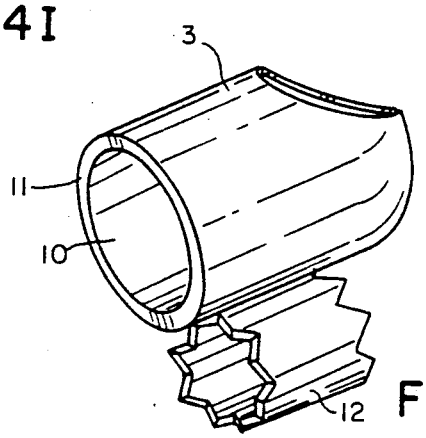

FIG. 4H shows a capsular thumb piece 3 oriented with its axis parallel with the axis of a thumb piece mounting means 12. The upper distal end of the capsule is removed to accommodate a protruding thumbnail. The mounting piece or sleeve 12 is proportioned to be received upon the shaft section 13 of the receiving stem 2, as shown in FIGS. 9A-9C. The cavity 10 of this special embodiment of thumb piece 3 houses the distal portion of the thumb. The thumb capsule could also rotate as in FIG. 4D, or a simple or modified cylinder could substitute for the capsule.

FIG. 4I shows an alternative cosmetic style of finger piece with attaching cylinder molded into one unit.

All of the above finger and thumb pieces can be designed in a variety of diameters, and many other potential variations are possible, particularly to accommodate handicapped users to maximize usable or distorted anatomy.

FIG. 5A illustrates a cylindrical mounting means or sleeve 5 having rectangular teeth for interdigitation with the end wall of another similar sleeve. The cylindrical mounting means or sleeve 5 shown in FIG. 5B is serrated at its ends having a plurality of sawtooth points 6.

FIG. 5C shows fine serrations and FIG. 5D shows an end of a mounting cylinder to be lined by a friction creating surface, in this case a rubber "0" ring, allowing an infinite degree of adjustment.

FIG. 6 is a sectional view along line 6—6 of the finger piece 4 illustrated in FIG. 4A mounted on its mounting means 5.

FIG. 7A illustrates a spacer 18 that has a cylindrical body and ends 6 that can be interdigitated with matching ends 6 of one or two adjoining finger pieces 4 and/or other spacers 18 (not shown). Spacers 18 can be of varying widths to appropriately separate adjacent finger cylinders 4 from the standpoint of personal preference or to create a desired configuration wherein only two or three finger pieces are used and spacers fill the rest of the shaft section of the receiving stem 1.

FIG. 7B shows one possible design of the first end member 7. In this particular embodiment, the first end member 7 is a cap having a cylindrical end portion equipped with an advancing spiral groove 16 or external thread on its outer surface which fits into a second spiral groove or internal thread 17 formed on the inner surface of the receiving stem 1. By screwing on the cap illustrated in FIG. 7A, the finger piece mounting means 5 and thereby the finger pieces 4 can be secured and maintained in a preset, optimum orientation.

FIGS. 8A–8D and 9A–9C show that the first and second receiving stems 1,2, and accordingly the finger piece and thumb piece mounting means or sleeves 5,12, which are sliding received on the shaft sections thereof, can be manufactured in different angular shapes and sizes to accommodate small, medium and large hands. Such curvatures allow the grips to be customized to best fit the anatomy of a user's hand and the intended use of the tool. Stems 1,2 could be made of a malleable substance, allowing the user to align the curvature to accommodate his particular anatomy.

FIG. 9D shows a thumb stem variation 24 that incorporates the proximal portion of the thumb and part of the palm into the gripping action. In this design, the thumb capsule is replaced with a cylinder.

Figure 10:
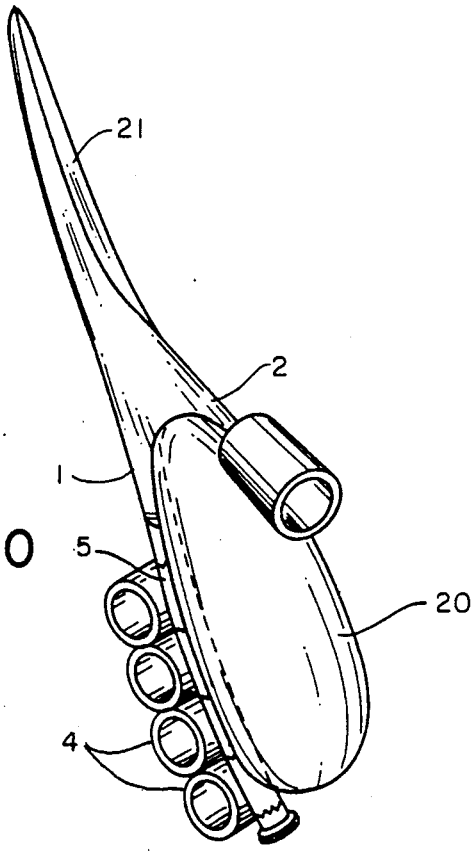
FIG. 10 is a perspective view of an arrangement in which the grip system according to the present invention is applied on a single hand grip tool.

FIG. 10 shows how the same concept can be applied to a knife, tool, or handle which is held by one hand. In this particular design, the first and second receiving stems 1,2 are placed below and above an oval ball 20 which forms a part of the grip that allows a user to precisely control the sharp blade 21. The thumb piece 3 and finger pieces 4 can be similarly slidably received on the shaft sections of the stems via their respective mounting means 12,5, or the thumb piece 3 might be affixed to the receiving stem 2 and/or to the ball 20 leaving only the finger pieces 4 to be adjustably oriented.

Figure 11:
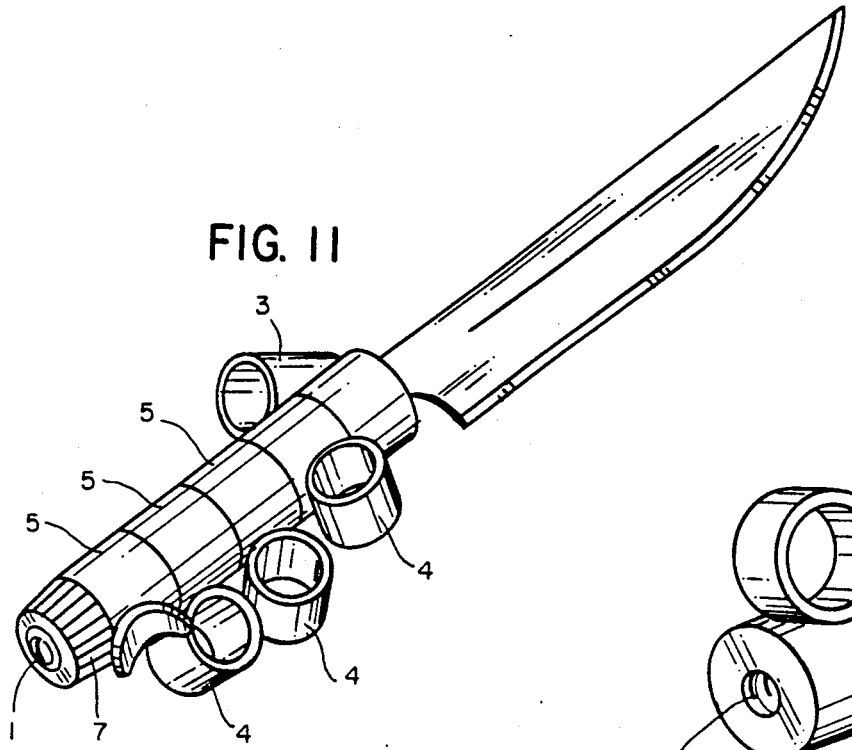
FIG. 11 is a perspective view showing the grip system applied to a knife.
Figure 12:
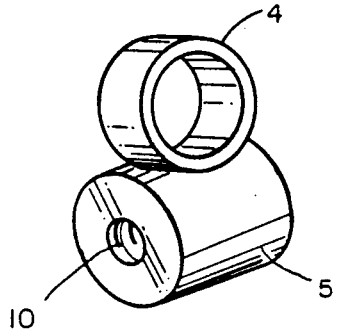
FIG. 12, similar to FIG. 4D, illustrates a finger cylinder attached to a mounting piece for the knife of FIG. 11.

FIG. 11 shows the same concept applied to a single hand-grip tool, in this case a knife, with a single stem that also functions as a handle. In this embodiment, the mounting cylinders 5 slide onto the stem as in FIG. 3A, with the possible configurations as depicted in FIGS. 4A–4H. The thumb cylinder or capsule could be located in different positions (not shown), lying parallel or perpendicular to the long axis of the handle, or at some other angle. FIG. 12 shows a finger cylinder attached to its mounting piece. A peg in hole mounting technique as depicted in FIG. 3C is also applicable to this embodiment (not shown).

Figure 13:
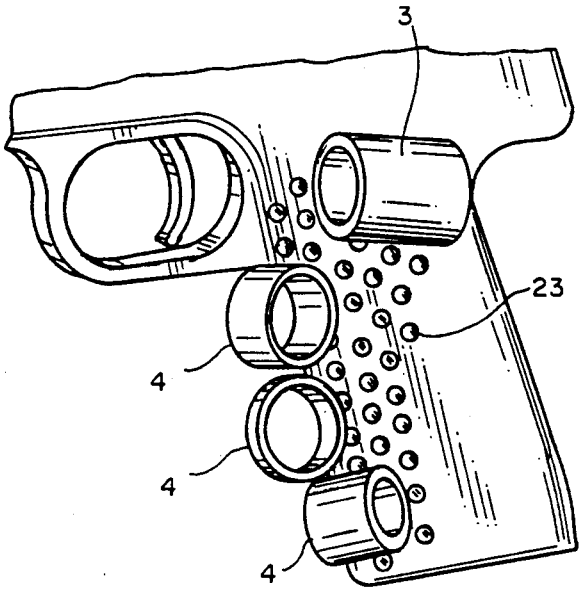
FIG. 13 shows a pistol-grip application.

FIG. 13 shows a pistol grip application employing finger cylinders 4 and a peg in hole mounting technique. All variables described in FIGS. 4A–4H would apply.

Figure 14:
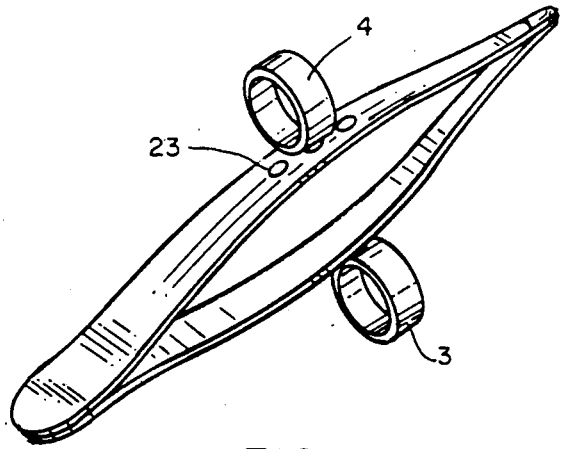
FIG. 14 shows a forceps application.

FIG. 14 shows a forceps application employing the same principles.

Figure 15:
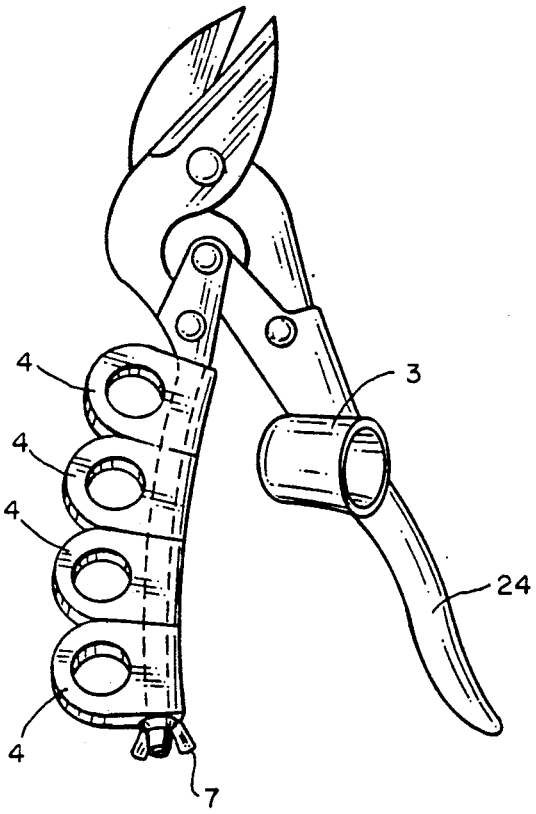
FIG. 15 shows an example of a double pivoting instrument incorporating finger pieces of the type shown in FIG. 4I for maximum power.

FIG. 15 shows an embodiment employing a possible alternative finger piece-mounting cylinder system as depicted in FIG. 4I. The additional thumb stem 24 referred to in FIG. 9D is present and a thumb cylinder 3 is shown. All parts in contact with flesh could be coated with a rubberized compound. By leaving the set wing nut 7 in a slightly loosened position, the finger pieces could slip and readjust as the tool is closed.

Figure 16:
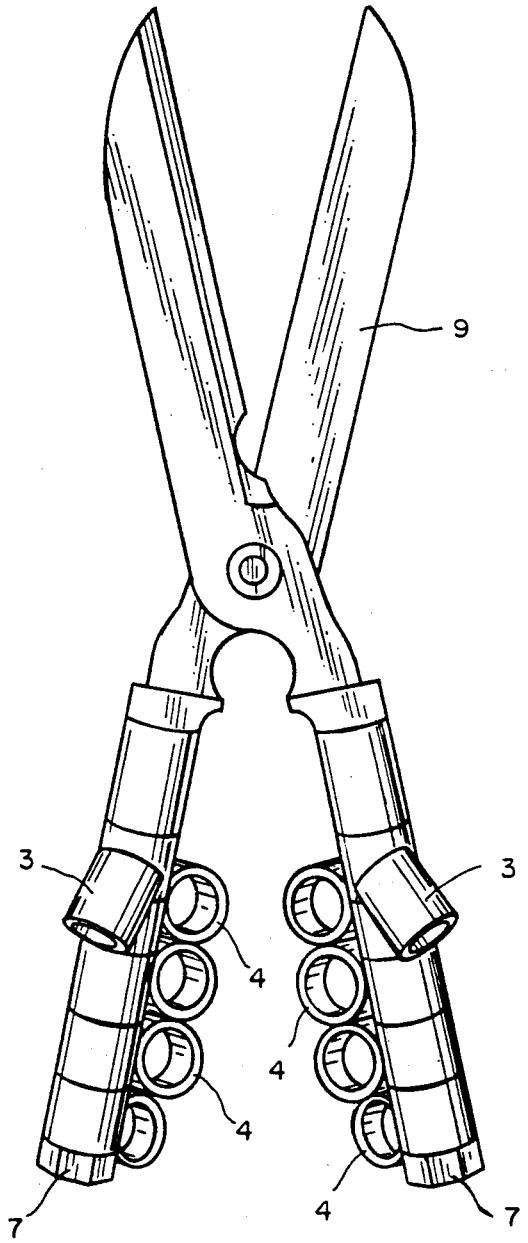
FIG. 16 shows the grip system applied to a tool held by both hands.

FIG. 16 shows an application on a tool that requires both hands.

The grip system according to the present invention can be made of any suitable material including strong plastics, composites, metals and even woods. The grip system may be coated with a rubber-like substance; or other suitable material to enhance user comfort and reduce slippage between the user's hand and the tool. The finger pieces, the thumb piece, their mounting means, the spacers as well as the respective receiving stems can all be manufactured in various sizes and shapes and can be standardized. Once a standardized sizing system is set up, custom devices can be manufactured. If desired, in a custom-made device the finger pieces and eventually the thumb piece may be overcoated with a plastic layer that improves the appearance and fixes the pieces in the desired, preset configuration. Tools or handgrips could be produced with the most popular configurations employing the above described system of individualized finger and thumb cylinders fixed on mounting stems in an anatomic configuration, such as small, medium and large, right or left handed.

It will be understood that although the present invention has been described in connection with some preferred embodiments thereof, alterations, additions, modifications, substitutions and deletions not specifically described may be made by those of ordinary skill in the art, without departing from the general concept of the invention. All these possible variations are intended to be within the scope of the present invention.

What is claimed is:

1. A combination of a grip system and a tool controlled by hand and having a first working portion and a first receiving stem extending from said first working portion, said grip system comprising:

a plurality of finger pieces, each having an inner surface for receiving a single finger, and a plurality of discrete mounting means, each having a cavity, an outer wall and a pair of ends, at least one of which ends is shaped for interdigitation with the adjacent end of another discrete mounting means, each of said mounting means being interconnected to only one of said finger pieces and being slidably received on said first receiving stem.

2. A combination of a grip system and a tool according to claim 1, further comprising at least one spacer having a cavity slidably received on said first receiving stem and a pair of ends which are each shaped for interdigitation with the adjacent end of an adjoining finger piece mounting means.

3. A combination of a grip system and a tool according to claim 1, wherein said first receiving stem includes a free end remote from said first working portion and further comprising a first end member interconnected with said free end of said first receiving stem to secure said plurality of discrete finger piece mounting means, and thereby the plurality of finger pieces attached thereto, upon said first receiving stem with each oriented at a desired angle.

4. A combination of a grip system and a tool according to claim 3, wherein said first end member has an edge for interdigitation with the adjacent end of the adjoining finger piece mounting means.

5. A grip system according to claim 1, further comprising a second receiving stem, and a thumb piece having a concave inner surface to accommodate the convexity of a thumb of a holding hand connected to said second receiving stem, and thumb piece mounting means, having a cavity, an outer wall and ends, for mounting said thumb piece on said second receiving stem so that said second receiving stem is housed in said cavity and said thumb piece is connected to said outer wall.

6. A grip system according to claim 5, further comprising a second end member for securing said thumb piece mounting means and thereby the thumb piece attached thereto, on said second receiving stem in a desired position.

7. A grip system according to claim 6, wherein said second end member has an edge that is interdigitated with the adjacent end of the adjoining thumb piece mounting means.

8. A grip system according to claim 7, wherein said second end member further has a cylindrical end portion equipped with an advancing spiral groove on its outer surface which fits into a spiral groove formed on the inner surface of said first receiving stem.

9. A combination of a grip system and a tool according to claim 1 wherein said inner surface of each said finger piece and each said finger piece mounting means each has a longitudinal axis, and wherein at least one of said finger pieces is secured to its respective mounting means so that its longitudinal axis is at an angle relative to the longitudinal axis of said finger piece mounting means.

10. A grip system according to claim 1, wherein at least one of said finger pieces is pivotally attached to its respective mounting means, whereby the last mentioned finger piece can pivot about its point of attachment tangential to the surface of said finger piece mounting means.

11. A grip system according to claim 5, wherein said thumb piece is secured to said second receiving stem so that its longitudinal axis is substantially parallel with the longitudinal axis of said second receiving stem.

12. A grip system according to claim 5, wherein said thumb piece is a capsular body that houses at least the ball of thumb.

13. A grip system according to claim 12, wherein said capsular body also houses the tip of the thumb.

14. A grip system according to claim 1 further comprising a thumb piece and wherein said thumb piece and said finger pieces are secured to the same receiving stem.

15. A grip system as set forth in claim 5 wherein said second receiving stem extends beyond said thumb piece to incorporate the thumb and part of the palm to assist in gripping.

16. A combination of a grip system and a tool as set forth in claim 1 wherein said stem is formed of malleable material.

17. A combination of a grip system and a tool controlled by hand and having a first working portion and a first receiving stem extending from said first working portion, said grip system comprising:

a plurality of finger pieces, each having an inner surface for receiving a single finger, and a plurality of discrete mounting means, each having a cavity, an outer wall and a pair of ends, at least one of which ends is shaped for interdigitation with the adjacent end of another discrete mounting means, each of said mounting means being interconnected to only one of said finger pieces and being slidably received on said first receiving stem, said first receiving stem including a free end remote from said first working portion, a first end member interconnected with said free end of said first receiving stem to secure said plurality of discrete finger piece mounting means, and thereby the plurality of finger pieces attached thereto, upon said first receiving stem with each oriented at a desired angle, said first end member having an edge for interdigitation with the adjacent end of the adjoining finger piece mounting means, and said first end member having a threaded portion and said free end of said first receiving stem having a threaded portion which is engageable with said threaded portion of said first end member.

18. A combination of a grip system and a pivoted hand tool, said tool having a first working portion, a first receiving stem connected to said first working portion, a second working portion, and a second receiving stem connected to said second working portion, each receiving stem having a longitudinal axis, said tool further comprising a pivot with said receiving stems being pivotally linked together by said pivot at the connection of said working portions and said receiving stems, said grip system comprising:

a thumb piece having a concave inner surface and having a longitudinal axis, secured to said first receiving stem so that the longitudinal axis of said thumb piece is substantially parallel to the longitudinal axis of said first receiving stem, a plurality of finger pieces, each having a concave inner surface for receiving a single finger, and a plurality of discrete mounting means, each having a cavity, an outer wall and ends at least one of which is interdigitated with the adjacent end of another said mounting means, for mounting said finger pieces on said second receiving stem so that said second receiving stem is housed in said cavities of said finger piece mounting means, each of said finger pieces being connected to the outer wall of only one of said mounting means.

19. A grip system according to claim 18, wherein at least one of said finger pieces is secured to its respective mounting means so that its longitudinal axis is at an angle relative to the longitudinal axis of said finger piece mounting means and said second receiving stem.

20. A grip system according to claim 18, wherein at least one of said finger pieces is pivotally attached to its respective mounting means, whereby the last mentioned finger piece can pivot about its point of attachment to the surface of said finger piece mounting means.

* * * * *

UNITED STATES PATENT AND TRADEMARK OFFICE

CERTIFICATE OF CORRECTION

PATENT NO. : 5,046,381

DATED : September 10, 1991

INVENTOR(S) : Lawrence P. Mueller

It is certified that error appears in the above-identified patent and that said Letters Patent is hereby corrected as shown below:

Column 1, line 4, after title insert--Background of the Invention--.

Column 1, line 5, before "Field of the Invention" insert --1.--.

Column 4, line 46, after "cavity" insert --or inner surface--.

Column 4, line 49, change "shifted" to --slidably positioned--.

Column 4, line 56, change "member7" to --member 7--.

Column 6, lines 31-32, change "16 or external thread" to --or external thread 16--.

UNITED STATES PATENT AND TRADEMARK OFFICE

CERTIFICATE OF CORRECTION

PATENT NO. : 5,046,381

DATED : September 10, 1991

INVENTOR(S) : Lawrence P. Mueller

It is certified that error appears in the above-identified patent and that said Letters Patent is hereby corrected as shown below:

Column 8, lines 28-32, Claim 6 should read as follows:

--6. A grip system according to Claim 5 wherein said first receiving stem includes a free end remote from said first working portion and further comprising a first end member interconnected with said free end to secure said plurality of discrete finger piece mounting means upon said first receiving stem with each finger piece oriented at a desired angle, a second end member for securing said thumb piece mounting means and thereby the thumb piece attached thereto, on said second receiving stem in a desired position.--

Signed and Sealed this

Ninth Day of March, 1993

*Attest:*

STEPHEN G. KUNIN

*Attesting Officer*

*Acting Commissioner of Patents and Trademarks*